US005421629A

United States Patent [19]

Karban

[11] Patent Number: 5,421,629

[45] Date of Patent: Jun. 6, 1995

[54] HOLDER FOR AFFIXING AND REMOVING PIERCED EAR EARRINGS

[76] Inventor: Martha A. Karban, 669 Knollwood Rd., White Plains, N.Y. 10603

[21] Appl. No.: 241,348

[22] Filed: May 11, 1994

[51] Int. Cl.[6] ..... B25B 9/02

[52] U.S. Cl. ..... 294/99.2; 606/210

[58] Field of Search ..... 294/1.1, 33, 99.2; 81/6–8, 13, 44; 606/188, 205–211

[56] References Cited

U.S. PATENT DOCUMENTS

| | | | |
|---|---|---|---|
| 849,789 | 4/1907 | Hurd | 294/99.2 |
| 1,284,060 | 11/1918 | Culman | 294/99.2 |
| 2,492,576 | 12/1949 | James | 294/99.2 X |
| 3,215,006 | 11/1965 | Urani | 294/99.2 X |
| 3,287,547 | 11/1966 | Spedding | 294/99.2 X |
| 3,481,641 | 12/1969 | Berger et al. | 294/99.2 X |
| 3,901,243 | 8/1975 | Read | 606/211 X |
| 4,247,140 | 1/1981 | Gordon | 294/99.2 X |
| 4,256,157 | 3/1981 | Grayson | 81/44 |
| 4,843,923 | 7/1989 | Voss | 81/44 |
| 5,047,049 | 9/1991 | Salai | 294/99.2 X |
| 5,263,968 | 11/1993 | Sorenson | 294/99.2 X |

*Primary Examiner*—Dean J. Kramer

[57] ABSTRACT

A device for assisting a user in affixing or removing pierced ear earrings. The device includes a handle portion and at least two wire fingers protruding therefrom that are used to support an earring nut when the earring is being affixed to the ear lobe, or removed therefrom. These wire fingers are typically thin flexible wires that either fit through circular openings in the earring nut or surround and clamp the earring nut. The handle portion of the device easily fits into the palm of the user, allowing the user to use her or his thumb and index finger to guide the wire fingers when affixing or removing the pierced ear earrings. The device is particularly useful to people having handicaps with finger motion, such as arthritis.

13 Claims, 2 Drawing Sheets

FIG. 1A
PRIOR ART
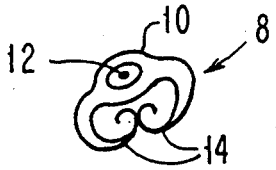
FIG. 1B
PRIOR ART
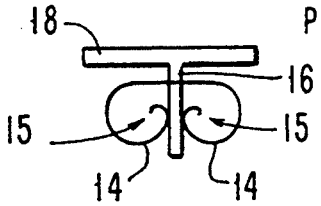
FIG. 2
PRIOR ART
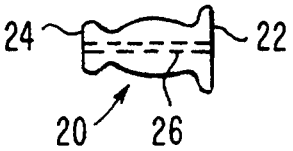
FIG. 3
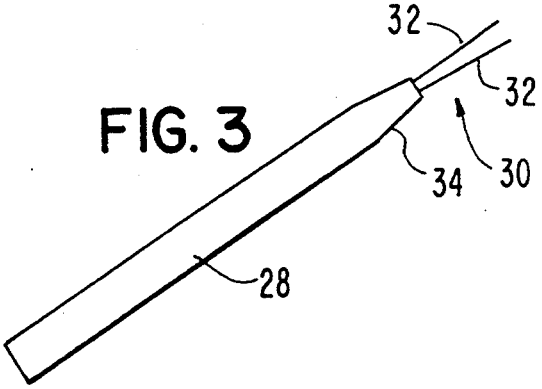
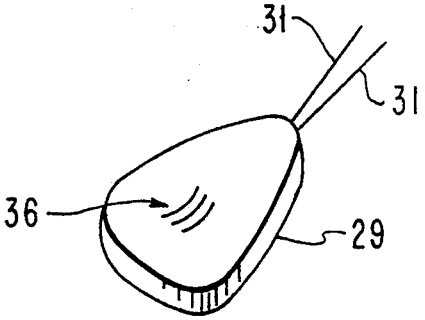
FIG. 4
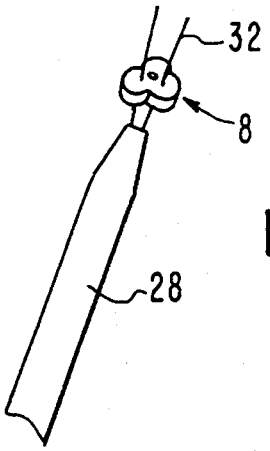
FIG. 5
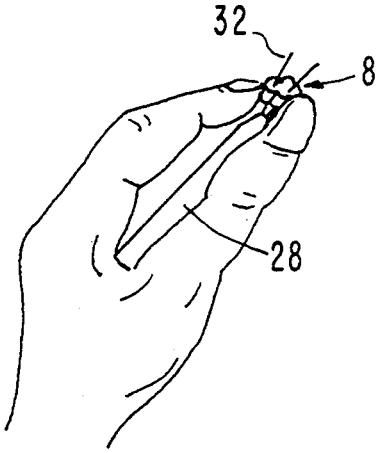
FIG. 6

HOLDER FOR AFFIXING AND REMOVING PIERCED EAR EARRINGS

DESCRIPTION

1. Field of the Invention

This invention relates to a holder and technique for affixing and removing pierced ear earrings, and more particularly to a holder that is used to support an earring nut during the process of affixing or removing a pierced ear earring from a person's ear lobe.

2. Background Art

The procedure of attaching a pierced ear earring to an ear lobe, and removing the earring from the ear lobe, is well known. The post, or stem, of the earring is inserted through a hole in the ear lobe and an earring nut is attached to the post behind the ear lobe in order to secure the earring to the ear lobe. Typically, the earring nuts are small devices having at least one opening into which the earring post is inserted, and some means to hold the earring nut to the post.

There are several types of earring nuts for pierced ear earrings, a common characteristic of the earring nuts being that they are very small and difficult to hold. One type of earring nut (shown in FIGS. 1A and 1B) has a front surface that abuts against the back of the ear lobe, there being a hole in this front surface through which the earring post is inserted. The rest of the earring nut is comprised of two spring-like coils that are in contact with each other prior to the insertion of an earring post into the earring nut. After insertion of the post through the hole in the front surface of the earring nut, the post is squeezed between the two spring-like coils, in order to secure the earring nut to the post.

Another type of earring nut is that illustrated in FIG. 2. This type of earring nut is characterized by being generally cylindrically shaped having a longitudinal opening therethrough into which the earring post is inserted. The front surface of this earring nut, which contacts the back of the ear lobe, is often larger than the back surface of the nut. The post is held in this type of an earring nut by a press fit.

Regardless of the type of earring nut to be used, the earring nuts are typically very small (so as to be cosmetically unobtrusive) and difficult to hold. This is particularly the situation if a person has any type of physical problem, as for instance if a person has arthritis in her (or his) fingers. The problem of holding the earring nut can also be present if a person has large fingers, if the person's hand is unsteady or if the person is relatively unfamiliar with the type of earring nut that is used.

Accordingly, it is a primary object of this invention to provide a holder for holding a pierced ear earring nut to facilitate the affixing of a pierced ear earring to a body part such as an ear lobe, and to facilitate the removal of the pierced ear earring from the body part.

It is another object of this invention to provide a device and technique for affixing and removing pierced ear earrings, without requiring a person to use her or his fingers to hold the earring nut.

It is another object of this invention to provide a holder for a pierced ear earring nut which is small, easy to use and inexpensive, the holder being suitable for use with different types of earring nuts.

It is another object of this invention to provide a small but effective holder for pierced ear earring nuts that can be easily carried in a pocket or purse and that can be used to easily and rapidly affix or remove pierced ear earrings.

It is another object of this invention to provide a device and technique enabling a person to affix a pierced ear earring to an ear lobe, or to remove the earring from the ear lobe, without having to grasp the earring nut by the person's fingers.

BRIEF SUMMARY OF THE INVENTION

The device of this invention is a small earring nut holder which can be easily hand-held by a person of any age, as well as by a person who would experience difficulty holding a small pierced ear earring nut. The device includes a first portion (handle) capable of being held or rested in a person's hand or palm, and a second portion which supports the earring nut during the process of affixing a pierced ear earring or removing a pierced ear earring from a body part, such as the ear. In a preferred embodiment, the second portion is comprised of two flexible "fingers" which extend from the handle. These fingers are typically made of a spring steel wire, and can fit through the coil openings of the earring nut shown in FIG. 1, or surround and press against the cylindrical body of the earring nut shown in FIG. 2.

The handle portion of this device can rest in a person's palm or be held by the person's fingers. In a preferred embodiment the handle has an elongated, generally cylindrical shape (such as a rod) where the two fingers extend from one end of the rod. As an alternative, the handle can have a different shape, such as a triangular shape that is easy to rest in a person's palm or that can be grasped between a person's fingers, where the wire fingers extend from the handle. The exact shape of the handle can be varied to accommodate people having different size fingers or different handicaps in using their fingers. This allows the device to be designed to accommodate different problems encountered by people without departing from the concept of the invention wherein protruding finger-like elements are used to hold the earring nut.

The protruding fingers are typically small wires, such as spring steel wires, which have a diameter and spacing to allow them to fit into the openings in the type of earring nut shown in FIG. 1, or to be shaped to press fit against the body of the earring nut shown in FIG. 2. It it also possible to use the same finger arrangement for affixing and removing both types of earring nuts. As an alternative, both types of fingers can be mounted or fastened in the same handle.

In operation, the device wire fingers engage the earring nut and support it, the person holding the handle while either placing the earring nut onto the earring post, or removing the earring nut from the post. Since the earring nut is supported by the wire fingers and not by a person's fingers, the acts of affixing and removing the earring nut are easily accomplished, even by a handicapped person.

These and other objects, features and advantages will be apparent from the following more particular description of the preferred embodiments.

BRIEF DESCRIPTION OF THE DRAWINGS

FIGS. 1A and 1B are two views of a first type of pierced ear earring nut having an opening through which an earring post is inserted and opposing circular sections between which the earring post is held.

FIG. 2 illustrates a second type of pierced ear earring nut, which is generally cylindrical in shape and of varying diameter along its length, there being a longitudinal opening in the earring nut into which the earring post is inserted.

FIG. 3 schematically illustrates one embodiment of an earring nut holder in accordance with the present invention, where the holder includes a handle portion capable of being rested or held in a person's hand and a second portion comprising thin finger-like protrusions that support the earring nut while the earring is being either affixed or removed.

FIG. 4 is a schematic illustration of another earring nut holder where the handle portion is triangular in shape.

FIG. 5 illustrates the use of the earring nut holder of FIG. 3 for affixing or removing earring nuts of the type shown in FIGS. 1A and 1B.

FIG. 6 illustrates a hand using the earring nut holder of the present invention to affix or remove a pierced ear earring nut.

DETAILED DESCRIPTION OF THE PREFERRED EMBODIMENTS

Figure 7:
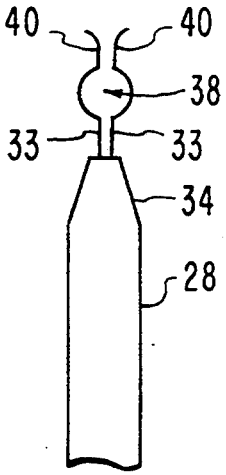
FIG. 7 is a schematic illustration of another type of earring nut holder that is particularly suited for holding earring nuts of the type shown in FIG. 2.

FIGS. 1A and 1B show two views of a well known earring nut 8 used for holding pierced ear earrings against a wearer's ear lobe. This type of earring nut includes a generally circular portion 10, having an opening 12 therein, and two coiled leaf spring members 14. Sometimes the area immediately surrounding opening 12 is slightly concave to allow the user to more easily locate the opening 12 when putting the earring nut on the post of the earring. Also, there is sometimes a recess in each of the spring portions 14, in order to prevent the post from slipping out of the grasp of the spring portions 14.

FIG. 1B is a side view of the earring nut of FIG. 1A, illustrating its use to hold the post 16 of a pierced earring 18. Due to the spring-like action of circular pieces 14, these pieces will press against post 16 in order to secure earring 18 to the user's ear lobe.

FIG. 2 shows another type 20 of pierced ear earring nut, which has an elongated, generally cylindrical shape of different diameter along its length. This type of nut generally has a front end 22 that is larger in diameter than the back end 24. An opening 26 extends from the front end of the nut to the back end, the diameter of the opening being such that it can be slid onto the post of a pierced ear earring, having a press fit thereto.

While the pierced ear earring nuts of FIGS. 1 and 2 can be of differing sizes, they are generally quite small and difficult to hold. This problem is accentuated if the user has any type of problem with her or his hands or fingers, or if the user's fingers are not particularly adapted to holding and manipulating very small objects.

In order to alleviate the problems described hereinabove, a device is provided for assisting the user in affixing an earring nut to an earring post, or removing the nut from the post. One such embodiment of this device is shown in FIG. 3. The device includes a first portion 28 which functions as a handle that is easily held by the person desiring to affix or remove a pierced ear earring. The second portion 30 of this device is comprised of at least two finger-like extensions 32 which jut out from one end of the handle portion 28. These "little fingers" 32 are used to substantially substitute for a person's fingers during the processes of attaching an earring nut to an earring post, or removing the nut from the post. That is, fingers 32 support the earring nut during these processes.

In a preferred embodiment, the holding portion 28 (handle) can be an elongated, rod-like member having a diameter of dimensions suitable to make it easily handheld, and made from a material of choice. For example, wood and/or plastics, ceramics or metals can be used to make the holder portion 28. If it is desired to provide an ornamental holder, portion 28 can be comprised of a more precious metal or decorated in any style.

In one embodiment, the handle portion 28 has a diameter of approximately $\frac{1}{4}$ inch and a length of approximately 3 inches (FIG. 3 and the other drawing figures are not necessarily to scale). The forward end 34 of the rod can be tapered to more easily allow one to place her or his fingers in contact with this portion when using the device. This will be more apparent from FIG. 6. The rear end of the rod can also be slightly tapered or rounded to provide a comfortable "feel" when in use.

The fingers 32 are typically short and thin, a suitable length being about $\frac{5}{8}$ of an inch long. They are preferably flexible and made of a material such as spring steel wire, plastic or rubber or plastic coated wire, about 1 millimeter in diameter. A suitable spacing of the wires 32 from each other is generally about $\frac{1}{8}$ inch. As will be seen, the spacing between fingers 32 is such that these fingers will fit through the openings 15 in the earring nut of FIGS. 1A and 1B. Of course, it will be apparent to those of skill in the art that the length of fingers 32, their spacing, and their diameter can be varied over wide ranges so long as they allow the device to hold the earring nut in the manner to be described with respect to FIGS. 5 and 8. Plastic or plastic coated wires, or wires with rounded ends, prevent a person from being hurt if by chance she or he is jabbed with the ends of the wires.

One way to make the device of FIG. 3 is to form an opening into the front end 34 of holder 28. Fingers 32 can be fashioned from a piece of wire which is bent (folded) in half, where the folded portion is inserted into the opening made in the forward end 34 of holder 28. As an alternative, two separate wires can be inserted into and held in the handle 28. A second alternative is to mold the wire fingers into a decorative handle (plastic, etc.).

The wires 32 are separated by approximately $\frac{1}{8}$ inch to accommodate the usual size of earring nuts shown in FIGS. 1A and 1B. Of course, the spacing of fingers 32 can be changed depending upon the size of the earring nuts. It is also possible to have the spacing of the fingers be such that the fingers have to be pressed slightly together in order to enter the openings 15 (FIG. 1B).

In FIG. 3, the wires 32 extend in a generally longitudinal direction from the end 34 of rod 28. However, it is suitable to have wire fingers 32 extend in other directions from rod 28, for exp., transverse (such as perpendicular) to the length of the rod.

FIG. 4 illustrates an embodiment in which the handle portion 29 is triangular in shape. This type of handle can also have a slightly concave region 36 in the center thereof to allow the handle to be easily grasped between the thumb and the index finger or held in the palm by a finger pressed against the concave region 36. Holding portions of differing size and shape can be provided for the comfort of different users, and for ornamental reasons.

It has been stated that, in a preferred embodiment, the wire fingers protrude approximately ⅝ of an inch from the holding portion 28. In practice, the length of the fingers 31, 32 can be varied over a wide range, where it is understood that if the fingers 31, 32 are too long the fingers may be harder to use or may strike a person's face or head when the device is used. Lengths up to about 1 or 1.5 inch may be suitable but ½–⅝ inch fingers are preferred. The lengths of the fingers need not be equal, although equal length fingers may be preferred. If the fingers 31, 32 are too short, they may not extend through openings 15 sufficiently to adequately hold the earring nut.

Similarly, the diameters of wires 31, 32 can be varied as long as they can be inserted into and removed from openings 15 in the earring nut. Metal wires of diameters about 43 thousandths of an inch have worked well, and have been sufficiently flexible for easy use, especially when used to hold the earring nuts of the type shown in FIG. 2.

FIG. 5 illustrates the use of this device (embodiment of FIG. 3) when affixing or removing an earring nut of the type shown in FIGS. 1A and 1B. First, the wire fingers 32 are inserted into the two openings 15 in the earring nut. With one hand, the person inserts the post of a pierced ear earring through the hole in an ear lobe. In the palm of the other hand, the person rests the handle portion 28. Using the thumb and index fingertips in the manner shown in FIG. 6, it is easy to direct the hole 12 of the earring nut onto the earring stem, or post 16. Once the earring nut is affixed to the earring post, the device is removed by gently pulling the handle portion 28 downwardly. This releases the fingers 32 from the openings 15 of the earring nut.

When removing the earring nut from the post 16, one hand is used to hold the pierced ear earring. The device is then rested in the palm of the other hand and the thumb and index fingertips are used to guide the wire fingers 32 into the holes 15 of the earring nut. Once the nut is placed onto fingers 32, the pierced ear earring is removed from the front of the ear lobe to release it from the earring nut. The earring nut does not fall because it is supported by the holder, and more specifically by the protruding fingers 32.

In order to accommodate the earring nut of FIG. 2, the wire fingers 33 are shaped slightly differently, as shown in FIG. 7. In this embodiment, the fingers 33 are close to one another except in a region about halfway along their length where they curve outwardly to create a generally circular opening 38 (detent zone) between the fingers 33. The ends 40 of the fingers optimally have a slight outward bend in this preferred embodiment. A plurality of detent areas of different size can also be provided along the length of fingers 33.

Figure 8:
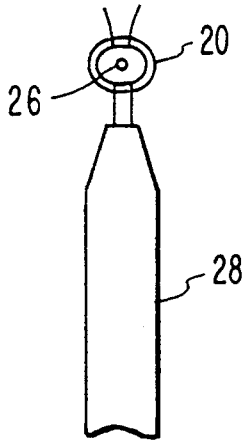
FIG. 8 shows the use of the holder of FIG. 7 to hold an earring nut of the type shown in FIG. 2.

FIG. 8 shows the use of the device of FIG. 7 to hold an earring nut of the type shown in FIG. 2. First, the earring nut 20 is placed between the outwardly bent ends 40 of the fingers 33, and pushed toward the handle 28 until it is located in the circular region 38. The pressure of fingers 33 against the earring nut 20 holds the earring nut in this position. Because there is a slight outward bend at the ends 40, it is easy to insert the earring nut between fingers 33 and move it towards the opening 38.

While the opening 38 is shown as having a generally circular shape, it will be understood that this opening can have different shapes if the fingers 33 are bent differently. For example, each of the fingers 33 can have a V-shaped bend in them so that the opening 38 is square, or diamond shaped. Since the purpose of the opening 38 is to provide an area in which the earring nut is squeezed and held by the fingers 33, the exact shape of the opening and its size can be made to accommodate the shape and size of the earring nut 20.

The device of FIG. 7 is used in the same manner as the device used to attach or remove earring nuts of the type shown in FIGS. 1A and 1B. For example, the earring nut 20 is placed into the detent zone 38 of the device. If a pierced ear earring is to be put into a person's left ear lobe, the right hand is used to insert the post of the earring into the ear lobe. The device of FIG. 7 is then rested in the palm of the left hand. Using the thumb and index fingertips to support the device enables the person to direct the axial hole 26 of the earring nut 20 onto the earring stem, or post. When the earring nut is affixed to the stem, the device can be easily removed by gently pulling the handle 28 downwardly i.e., in a direction transverse to the longitudinal direction of the stem. This releases the fingers 33 from the round earring nut.

Once the earring nut has been attached to the earring post, the fingers 33 are removed by moving them in a downward direction transverse to the longitudinal direction of the post. This ensures easy removal of the fingers 33 from the earring nut, without loosening the nut or moving it along the length of the post to which it is attached. Also, because the fingers 33 extend in a plane transverse to the longitudinal direction of the earring post when the device is used, the fingers 33 do not cause injury to the person by pricking an ear lobe or another portion of the person's head.

To remove the round earring nut 20, the right hand is used to hold onto the earring in the left ear lobe. The handle 28 is supported in the palm of the left hand and the thumb and index fingertips guide the wire fingers 33 upwards to engage the detent area 38 onto the earring nut. When the earring nut is secure in detent area 38, the earring is removed from the front of the ear lobe to release it from the earring nut. Because the earring nut is securely held in the detent area between fingers 33, the earring nut will not be dropped and lost. Again, the wire fingers 33 engage the earring nut by moving them in a direction that is generally transverse to the length of the post. This prevents the fingers 33 from jabbing the person.

The device of FIG. 7 can also be used with earring nuts of the type shown in FIGS. 1A, 1B. In this situation, the earring nut would be held by the wire fingers at a location just above the detent area 38, the ends of the wires 33 passing through the openings 15 in the earring nut.

Figure 9:
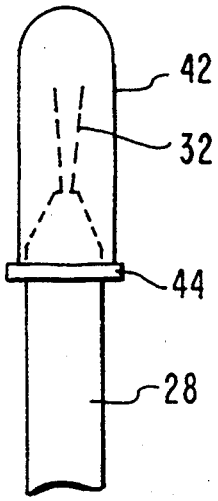
FIG. 9 schematically illustrates a convenient way to package the earring nut holder of the present invention when not in use, and in particular the provision of a protective cap covering the protruding fingers.

FIG. 9 shows the device of FIG. 3, protected by a cap 42. This cap has a length sufficient to completely cover the fingers 32, and in operation slides snugly over the handle portion 28 of the device. A flange 44 can be provided along the outer diameter of handle 28, to act as a stop for cap 42. This will prevent the user from forcing the cap 42 too far along handle 28, and will therefore prevent the inside of the cap from damaging the ends of fingers 32.

As an alternative, the protective cap can be screwed onto the handle 28, or other types of hold-release mechanisms can be used, as are well known in the art. An example is a cap having an internal taper that fits snugly against a matching taper on the handle 28. Protective cap 42 can be made from many materials, such as metals, plastics, glass and rubber.

Figure 10:
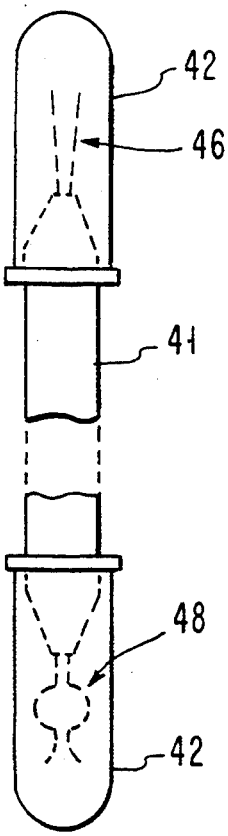
FIG. 10 schematically illustrates an earring nut holder in accordance with the present invention, where each end of the handle has a set of wire fingers protruding therefrom, one set of wire fingers being for one type of earring nut, and the other set being for another type of earring nut.

FIG. 10 illustrates a double-ended device where two sets of wire fingers are held by the same handle 41. On one end of handle 41 is a first set 46 of wire fingers of the type shown in FIGS. 3 and 4, while on the other end of handle 41 is a second set 48 of wire fingers of the type shown in FIG. 7. A protective cap 42 is located at each end of the device to protect both wire finger sets 46 and 48. The device of FIG. 10 can therefore be used to affix and remove pierced ear earrings using each type of earring nut. As an alternative, the handle can have snap-fit openings into which sets 46 and 48 can be inserted and removed. Another alternative is an end piece that can be removably secured to the handle 41 by any well known means, where the end piece holds either wire finger set 46 or set 48. The end pieces would be akin to removable "heads" that are designed for specific purposes.

What has been described is a holder for holding earring nuts of the type used with pierced ear earrings, in order to facilitate affixing and removal of pierced ear earrings. The device is small and of light weight, and is easily held and carried by a person. Based on the principles of this invention, the handle portion and fingers can be made of different materials and varied in size, shape, spacing and dimensions to accommodate various types of earring nuts. While two wire fingers are adequate to hold the earring nuts, it is within the scope of this invention to have more than two wire fingers attached to the handle. Thus, while the invention has been shown with respect to particular embodiments thereof, it will be appreciated by those of skill in the art that variations can be made therein without departing from the spirit and scope of the invention, which is to be limited only by the claims issuing thereon.

I claim:

1. A method for affixing or removing pierced ear earrings at a person's ear lobe, including the steps of:

holding a pierced ear earring having an earring post attached thereto in one hand, said post having been inserted through an opening in the person's ear lobe, contacting an earring nut adapted to be fit onto said post securing said earring to said ear lobe by flexible wire fingers, said earring nut being supported by said wire fingers, and producing relative motion between said earring nut and said post to insert said post into or remove said post from said earring nut while said earring nut is being supported by said flexible wire fingers.

2. The method of claim 1, where said flexible wire fingers are supported on a handle, said handle being held by the person's other hand while producing said relative motion.

3. The method of claim 2, where said contacting step includes passing said flexible wire fingers through openings in said earring nut.

4. The method of claim 2, where said contacting step includes clamping said earring nut between said flexible wire fingers.

5. A device for assisting a person in affixing and removing pierced ear earrings, said earrings having a post extending therefrom to which an earring nut is attached when said earrings are worn, said device including:

a handle capable of being easily supported by a person, a first set of at least two small flexible fingers extending from said handle a short distance and being generally parallel to one another, said flexible fingers being separated from one another at at least one location along their length, the separation of said flexible fingers being sufficiently small to allow an earring nut to be fit between and held by the spring action of said flexible fingers against said earring nut, said flexible fingers being generally rounded and having a diameter sufficiently small enough to allow said flexible fingers to pass through openings in said earring nut, said device supporting said earring nut when said earring post is inserted into or removed from said earring nut.

6. A device for assisting a person in affixing and removing pierced ear earrings, said earrings having a post extending therefrom to which an earring nut is attached when said earrings are worn, said device including:

a handle capable of being easily supported by a person, a first set of at least two small flexible fingers extending from said handle a short distance, said flexible fingers being separated from one another at at least one location along their length, the separation of said flexible fingers being sufficiently small to allow an earring nut to be fit between and held by said flexible fingers, said flexible fingers being generally rounded and having a diameter sufficiently small enough to allow said flexible fingers to pass through openings in said earring nut, said device supporting said earring nut when said earring post is inserted into or removed from said earring nut, where said flexible fingers are wires extending less than about 1.5 inches from said handle.

7. The device of claim 6, where said fingers have diameters less than about 1.5 mm.

8. The device of claim 7, further including a removable protective cap that can be placed on said handle to surround said fingers when said device is not in use.

9. The device of claim 7, where said fingers are made of flexible metal wires.

10. A device for assisting a person in affixing and removing pierced ear earrings, said earrings having a post extending therefrom to which an earring nut is attached when said earrings are worn, said device including:

a handle capable of being easily supported by a person, a first set of at least two small flexible fingers extending from said handle a short distance, said flexible fingers being separated from one another at at least one location along their length, the separation of said flexible fingers being sufficiently small to allow an earring nut to be fit between and held by said flexible fingers, said flexible fingers being generally rounded and having a diameter sufficiently small enough to allow said flexible fingers to pass through openings in said earring nut, said device supporting said earring nut when said earring post is inserted into or removed from said earring nut, said device further including a second set of at least two small flexible fingers extending in a different direction from said handle, said first and second sets being adapted to support different types of earring nuts.

11. The device of claim 10, where said second set of small flexible fingers extends from said handle at a different location than said first set of flexible fingers.

12. A device for assisting a person in affixing and removing pierced ear earrings, said earrings having a post extending therefrom to which an earring nut is attached when said earrings are worn, said device including:

a handle capable of being easily supported by a person, a first set of at least two small flexible fingers extending from said handle a short distance, said flexible fingers being separated from one another at at least one location along their length, the separation of said flexible fingers being sufficiently small to allow an earring nut to be fit between and held by said flexible fingers, said flexible fingers being generally rounded and having a diameter sufficiently small enough to allow said flexible fingers to pass through openings in said earring nut, said device supporting said earring nut when said earring post is inserted into or removed from said earring nut, where said small flexible fingers are curved to form an opening therebetween into which said earring nut can be inserted and held by said fingers.

13. The device of claim 12, where said opening is a generally circular opening.

* * * * *